US008113481B1

(12) United States Patent
Krysak

(10) Patent No.: US 8,113,481 B1
(45) Date of Patent: Feb. 14, 2012

(54) DEVICE FOR CARRYING ANIMAL WASTE BAGS

(76) Inventor: David Matthew Krysak, Chicago, IL (US)

( * ) Notice: Subject to any disclaimer, the term of this patent is extended or adjusted under 35 U.S.C. 154(b) by 0 days.

(21) Appl. No.: 13/082,728

(22) Filed: Apr. 8, 2011

(51) Int. Cl.
*A47G 29/00* (2006.01)

(52) U.S. Cl. ..... 248/690; 248/95; 248/222.41; 248/304; 24/343; D8/367

(58) Field of Classification Search ..... 248/95, 248/682, 690, 304, 309.1, 305, 315, 316.1, 248/222.41; 24/30.5 R, 30.5 S, 343, 563; 224/269, 681, 682, 675; 119/795; D8/367
See application file for complete search history.

(56) References Cited

U.S. PATENT DOCUMENTS 3,243,087 A * 3/1966 Pulitzer ..... 223/87
4,135,693 A * 1/1979 Miavitz ..... 248/339
4,783,886 A 11/1988 Koppe
4,851,977 A * 7/1989 Gary ..... 362/249.01
5,046,222 A * 9/1991 Byers et al. ..... 24/343
5,167,377 A 12/1992 Chalmers
5,311,646 A 5/1994 Eischen, Sr.
5,381,588 A 1/1995 Nelson
D360,127 S * 7/1995 Stiner ..... D8/367
5,429,284 A * 7/1995 Kolton et al. ..... 223/85
D389,728 S * 1/1998 Fitzwater ..... D8/367
D391,146 S * 2/1998 Cutler ..... D8/367
5,727,500 A 3/1998 Conboy
6,062,521 A * 5/2000 Kelley et al. ..... 248/339
6,076,783 A * 6/2000 Card ..... 248/99
6,193,198 B1 * 2/2001 Baur et al. ..... 248/222.41
6,223,695 B1 5/2001 Edwards et al.
6,389,652 B1 5/2002 Williams
2008/0017121 A1 1/2008 Mauro
2009/0172926 A1 7/2009 Kern

* cited by examiner

*Primary Examiner* — Anita M King

(57) ABSTRACT

A method and device for carrying animal waste bags made from a unitary body comprising a hook for transporting the device and apertures to seal and hold the bags. The bags are inserted into an aperture and drawn through a compression slot which temporarily seals the bags. The device can then be attached to a variety of objects utilizing the integrated hook for hands free transportation of the waste bags.

14 Claims, 3 Drawing Sheets

DEVICE FOR CARRYING ANIMAL WASTE BAGS

REFERENCES CITED

Not Applicable.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

SEQUENCE LISTING

Not Applicable.

BACKGROUND OF THE INVENTION

1. Prior Art

The following is a tabulation of some prior art that presently appears relevant:

U.S. patents

| U.S. Pat. No. | Kind Code | Issue Date | Patentee |
|---|---|---|---|
| 6,389,652 | B1 | May 21, 2002 | Williams |
| 6,223,695 | B1 | May 1, 2001 | Edwards et al. |
| 5,727,500 | | Mar. 17, 1998 | Conboy |
| 5,381,588 | | Jan. 17, 1995 | Nelson |
| 5,311,646 | | May 17, 1994 | Eischen, Sr. |
| 5,167,377 | | Dec. 1, 1992 | Chalmers |
| 4,783,886 | | Nov. 15, 1988 | Koppe |

U.S. patent application

| Publication Number | Kind Code | Publication Date | Applicant |
|---|---|---|---|
| 2009/0172926 | A1 | Jul. 9, 2009 | Kern |
| 2008/0017121 | A1 | Jan. 24, 2008 | Mauro |

2. Field of the Invention

The patent invented generally relates to a method of and device for carrying animal waste bags.

The proper disposal of animal waste, whether in an urban metropolis or rural backcountry, can present a real problem especially for handlers of domestic pets, such as canines. The waste left behind, within urban metropolises, attracts unwanted and potentially disease carrying nuisances, such as rodents. The potential health risk posed by the nuisances has led many city municipalities within the United States to pass ordinances enforcing fines on handlers of pets that do not remove their pet waste. Additionally both United States federal and United States state parks have passed similar regulation regarding the removal of waste produced by visitors, including that of accompanying animals. This poses an additional problem as park visitors must temporarily store the waste generated during their stay, to be disposed of upon exiting the park.

The present and most acceptable means for removing waste is the use of a plastic bag. The bag is place over the user's hand where it functions as a barrier. The waste is then picked up and the bag inverted to contain the waste where it is held until a designated garbage receptacle is located.

The problem with the aforementioned means for removal is how to transport the bag of waste until an appropriate means of disposal is located. In the case of an urban metropolis the animal handler is left with limited options; either place the bag in a pocket of their clothing or carry the bag in their free hand. Placing the waste bag in a pocket is both unsanitary and may led to a mess should the bag rupture. Similarly disadvantageous, carrying the waste bag in the free hand reduces the handlers control over the animal and inhibits social greetings, such as handshakes, between handlers.

In the case of the rural backcountry hiker, yet another problem exists where all waste accumulated during the stay must be disposed of upon exit of the park. The use of multiple partially-filled plastic bags is not a practical option; It is more practical to reuse the same waste bag until it is reasonably full.

Yet another problem is the management of unpleasant odors. Once the handler has placed the waste in the plastic bag the handler is left with two options to control odors either tie a knot in the bag or hold the opening of the bag closed, both of which require use of the free hand. Should, and as is the case many times, the animal relieve itself a second or third time and a knotted bag would result in the use of another bag and generate more waste. Leaving the bag unknotted, allows the bag to be used several times but the handler must continually hold the bag shut to prevent odors from escaping. Odors escaping from a waste bag can be particularly unpleasant when trying to have a conversation with pedestrians while walking the animal. Thus the problem exists of how to transport an unsealed or similarly unknotted waste bag that is secure, temporarily seals the bag and is self supporting.

The invention was created to address the needs of animal handlers when dealing with the waste produced by their pets. The invention resulted in unexpected results such as, it efficiently and temporarily seals multiple plastic bags filled with animal waste, it can be used in a variety of hands free configurations, it is durable, portable and requires no additional tools or attachment means.

3. Description of Related Art

The prior art discloses closure clips or leash assembly devices for plastic bags. One such device is shown in U.S. Pat. No. 6,389,652 issued to Williams discloses a thin, flat bodied, closure clip for plastic bags. A disadvantage to the device is that it is designed to be placed on a plastic bag and is not resilient enough to clasp the bag and transport it. Yet another disadvantage is the body made from thin material which does not have enough surface friction to overcome and prevent a weighted plastic bag from slipping out of the bag accepting area.

A similar device is disclosed in U.S. Pat. No. 6,223,695 issued to Edwards et al. discloses a leash assembly having a refuse bag dispenser. The device disclosed is complicated to operate, expensive to manufacture and designed to hold a high capacity of unused waste bags. A disadvantage to the device is that the animal handler is carrying a large, cylindrical device filled with unused waste bags, it is not convenient to carry more then a reasonable number of bags with respect to the number of animals being simultaneously walked. Yet another disadvantage is the lack of a means to securely hold a filled waste bag that is not knotted, the device disclosed requires that the waste bag be knotted once full and loosely hung on a hook located at the bottom of the device. Yet another disadvantage is the complex means for attaching the device, which require additional equipment such as a ring, a bead tie or guides mounted on a particular real leash to attach the device and thereby limiting the devices utility.

A similar device is disclosed in U.S. Pat. No. 5,727,500 issued to Conboy discloses a device for transporting animal waste in a pouch attached to an animal's leash. A disadvantage to the device is it requires the waste bags to be tied in a knot prior to placing them within the carrying pouch; if the bags were not knotted they would spill into the pouch. Additionally should the waste bags have a small hole it would result in the waste leaking into the pouch and requiring a through sanitization of the pouch. Yet another disadvantage is the means of support of the device. The device incorporates hook and loop fastening system to attach the device to a, standard rope or web type, leash at the top and bottom of the device.

A similar device is disclosed in U.S. Pat. No. 5,381,588 issued to Nelson discloses a device for retaining paired items; such as socks. The devices body is made from a thin material and relies on resilient fingers to clasp the items. A disadvantage to the device is that it is limited to the amount of weight the device can retain due to the thin and flexible material used. The materials thinness produces the devices resilient fingers, which are used to grasp the items; however this thinness also limits the amount of weight the device can support without buckling.

A similar device is disclosed in U.S. Pat. No. 5,311,646 issued to Eischen, Sr. and U.S. Pat. No. 4,783,886 issued to Koppe each disclose sheet-like bodied plastic bag closures. These devices incorporate a thin flat body that includes a slit for which a plastic bag is drawn into an aperture and incorporates gripping teeth or points to hold the closure on the bags. Disadvantages to these devices are the gripping means, as these protrusions within the aperture can snag and tear holes into plastic bags.

A similar device is disclosed in U.S. Pat. No. 5,167,377 issued to Chalmers discloses a cylindrical animal waste bag dispenser. The device incorporates a handle for carrying the device and a sharp spike opposite the handle for standing the device on the ground. A disadvantage to this device is the lack of integrated means for carrying the device other than a handle. Yet another disadvantage is the large spike at the bottom of the device and its proximity to the means for carrying filled waste bags. Yet another disadvantage is the location and orientation of the slot as the device does not have a ridged supporting connection preventing the rotational movement imparted on the device by a weighted waste bag. Once a filled waste bag is attached to the device, the device will hang to one side or listing in the direction of the filled bag and consequently in the same orientation of the slot leaving the bag prone to slipping out on impact as experienced during running, brisk walking or sudden movement by the animal.

A similar device is disclosed in U.S. patent application Ser. No. 11/971,885 by Kern discloses a leach assembly with two opposed strips of hook and loop fastener for securing waste bags. A disadvantage to the devices disclosed is the fasting means requires the bags have a hole for fastening. Yet another disadvantage is the device is an integrated assembly in a leash and cannot be removed or transferred to another leash.

A similar device is disclosed in U.S. patent application Ser. No. 11/489,839 by Mauro discloses a refuse bag holder consisting of a cord and mechanical clamp to hold the waste bag in place. The device requires a bracket or similar mean for attaching the device to an object which is disadvantageous. Yet another disadvantage is the device cannot independently and simultaneously hold empty and filled waste bags. Yet another disadvantage is the use of a spring loaded mechanical means for securing the bags as the mechanical components are susceptible to corrosion and failure.

The prior art disclosed does not specifically address the aforementioned problem. The prior art disclosed are overcomplicated, mechanical, cannot support the weight of a filled plastic waste bag and do not allow for a variety of hands fee configurations. Further the nature of the prior art disclosed is either secondary to another principle invention or directed to the closure of food related plastic bags. Hence, there is a need exists for a device that can temporarily seal and hold multiple plastic bags filled with animal waste efficiently, can be used in a variety of hands free configurations, is durable and requires no additional tools or attachment means, is low cost to manufacture and consequently low price to the consumer.

BRIEF SUMMARY OF THE INVENTION

In accordance with one embodiment a waste bag carrying device comprising a resilient unitary elongated rectangular cuboid body comprised of a integrated hook at one end used to support the device and a series of juxtaposed spaced-apart lobe shaped apertures. To use the device the open end of the waste bag is inserted in to one of the apertures, where the aperture guides the bag into the open end of the corresponding slot, and thereby compresses the bag into the gripping aperture at the closed end of the slot temporarily sealing and securely holding the bag. The integrated hook allows the device to be carried hands free by either attaching the device to a leash, belt, backpack or other convenient means of transport.

Accordingly several advantages of one or more aspects are as follows: to provide a waste bag carrying device that is made from a single piece of material, that incorporates a series of apertures to simultaneously and independently accept empty and filled waste bags, that is designed to be hands free to carry, that is designed to hold and temporarily seal plastic bags securely and nondestructively, that is designed to be flexible and resilient, that is easily manufactured and consequently low cost to the consumer, that requires no additional tools or assembly for use and is comfortable to use. These and other advantages of one or more aspects will become apparent from a consideration of the ensuing descriptions and accompanying drawings.

DETAILED DESCRIPTION OF THE INVENTION

Figure 1:
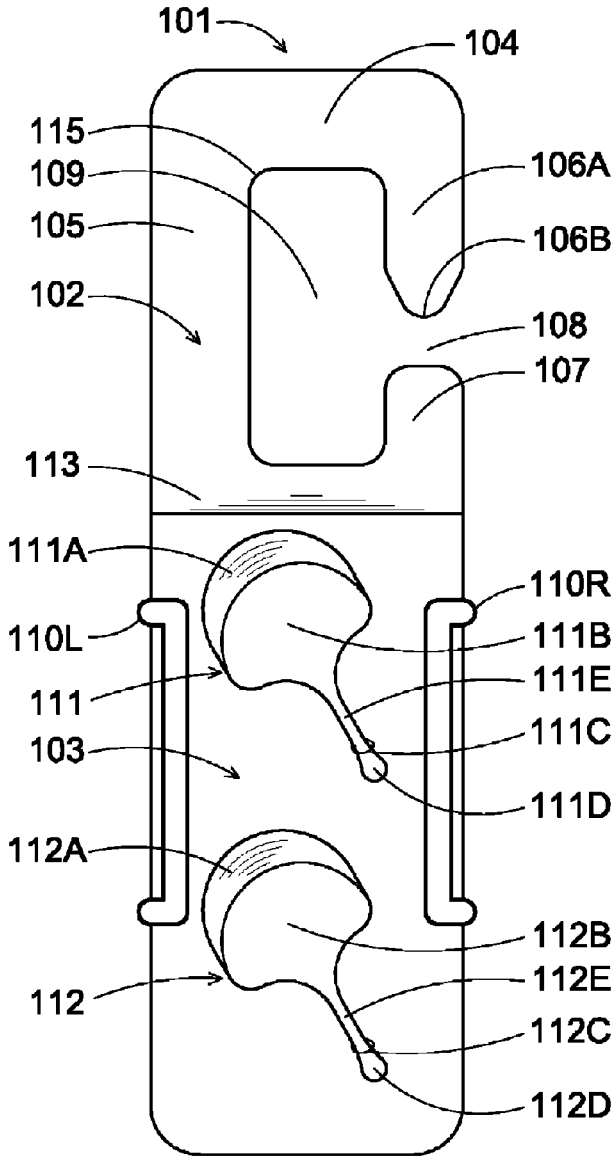
FIG. 1 shows the front elevation of the device.
Figure 2:
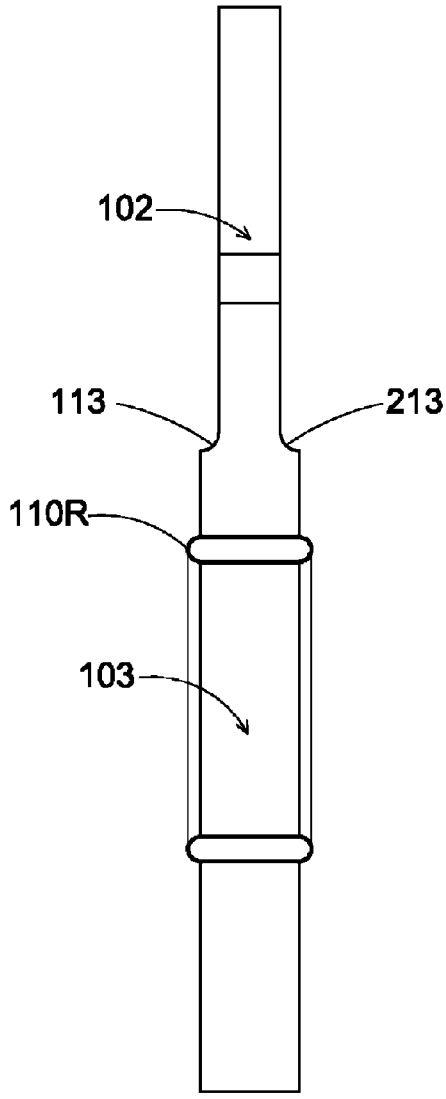
FIG. 2 shows a side elevation of the device.
Figure 3:
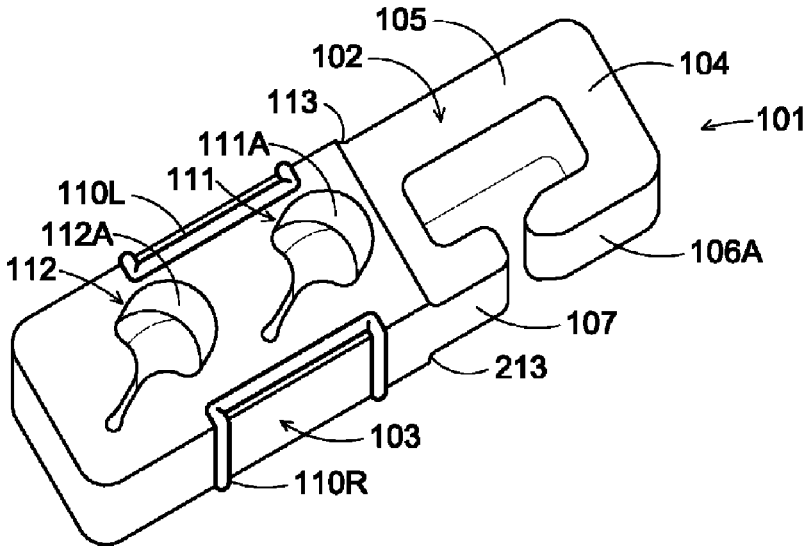
FIG. 3 shows an isometric perspective of the device.

Referring to the drawings and particularly FIG. 1 generally depicts one embodiment of the waste bag carrying device 101. Device 101 comprises a unitary body separated into a shallower upper body 102 and deeper lower body 103 and separated by chamfered edge 113 on the front and chamfered edge 213 on the back as illustrated in FIG. 2. Wherein said upper body 102 may be between 0.125" and 0.3125" in depth and said lower body may be between 0.5" and 0.75" in depth as illustrated in FIG. 3. In FIG. 1 upper body 102 is defined by member 105, 104 and 106A which together generally form a hook shape creating void 109. In FIG. 1 Member 106A is further defined by termination point 106B which is tapered and juxtaposed to dog or spur 107 and thereby creating slot 108. Lower body 103 comprising two juxtaposed spread-apart lobe shaped apertures 111 and 112 and two salient, cylindrically shaped ribs 110L and 110R. Referring to FIG. 3, rib 110L and 110R can be seen wrapping around lower body 103 and are symmetrical on both the front and back faces of lower body 103. The ribs provide a secure grip while using the device especially advantageous while wearing gloves or mittens.

Aperture 111 is lobe shaped with a protruding slot, extending outwardly from one side, centrally located within body 101 and rotated offset from the primary axis as illustrated in FIG. 1. Said aperture 111 is defined by a concaved lune shaped lead-in notch 111A, compression members 111C, and grasping aperture 111D, said aperture 111 further comprising semi-circular void 111B and slot 111E as defined between lead-in notch 111A and members 111C. I presently contemplate for this embodiment that void 111B be sized to accommodate a human finger or thumb and may be between 0.25" and 1" in radius. Similarly, aperture 112 is defined by a concaved lune shaped lead-in notch 112A, compression members 112C, and grasping aperture 112D, said aperture 112 further comprising semi-circular void 112B and slot 112E as defined between lead-in notch 112A and members 111C. I presently contemplate for this embodiment that the void 112B sized to accommodate a human finger or thumb and may be between 0.25" and 1" in radius.

Device 101, is preferably formed from a semi-rigid and resilient material amendable to injection or compression mold manufacturing, as is commonly know in the art. The material maybe, for example silicone rubber or vulcanized rubber in another embodiment of the invention, the device may be formed from a plastic having semi-rigid characteristics. A plastic suitable for this purpose may be polyurethane, polypropylene or polyethylene. This list is not exclusive and other materials commonly know in the art may be utilized.

Figure 5:
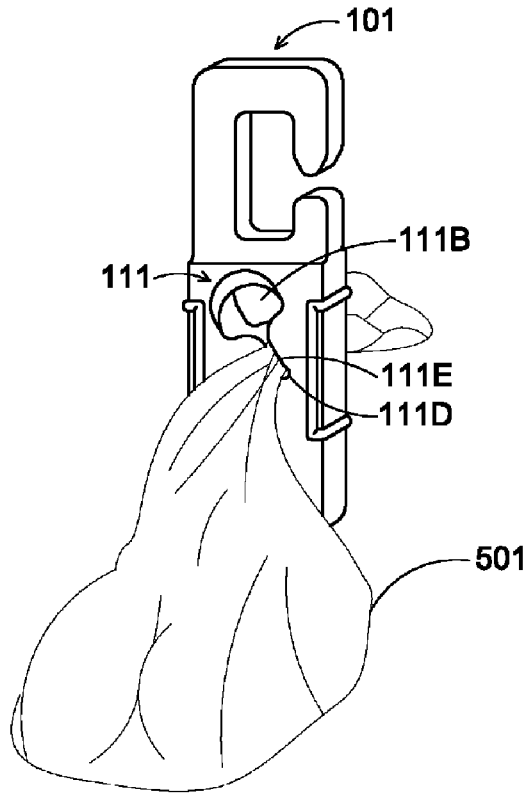
FIG. 5 shows the device from FIG. 1 holding a waste bag.

Referring now to FIG. 5 depicts the use of aperture 111 whereby the user grasps device 101 and passes an unsealed open end of plastic bag 501, using a finger or thumb through void 111B. Once said bag 501 is reasonably through void 111B, bag 501 is drawn down through slot 111E towards grasping aperture 111D wherein the friction imparted on the bag by members 111C are substantial enough to temporarily seal and support the unsealed plastic bad; the device is now considered loaded. The friction generated an unexpected result of securely sealing in odors while non-destructively gripping the bag as a result of the combination in the length and width of slot 111E and grasping aperture 111D, the depth of lower member 103 and the resilience of the material used in device 101. A similar process is observed in the use of aperture 112 whether concurrent or independent of aperture 111. An additional advantage is the device can carry several unused waste bags.

Figure 6:
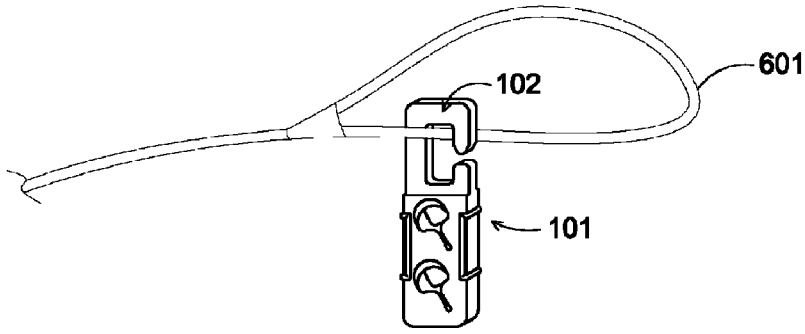
FIG. 6 shows the device from FIG. 1 attached to a generic rope leash.

In one embodiment as illustrated in FIG. 6, device 101 is reasonably attached to a standard rope type leash 601 by firmly grasping lower body 103 and pressing the leash through slot 108, whereby the device is hung from upper body 102. Slot 108 is sized to be smaller than a standard rope leash. Member 106A utilizes the resilience of the material to temporarily deform and return to its original shape to accept the leash. It is an unexpected result that once device 101 is loaded and reasonably attached to leash 601, device 101 will tend to rotate, under the weight of said loaded bag, until said aperture slots are reasonably vertical in orientation; this results in device 101 rotating about leash 601 until seated on inside corner 115, which is opposite slot 108 resulting in a secure connection.

Figure 7:
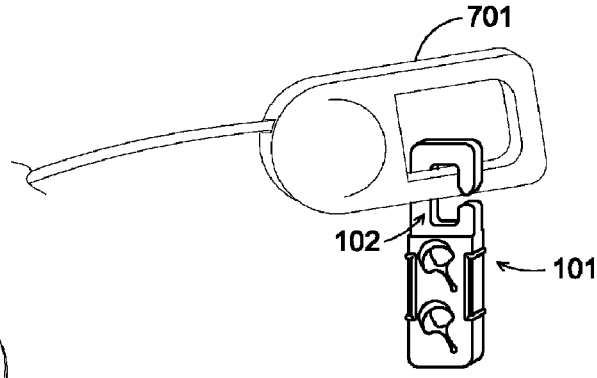
FIG. 7 shows the device from FIG. 1 attached to a generic reel-leash.
Figure 8:
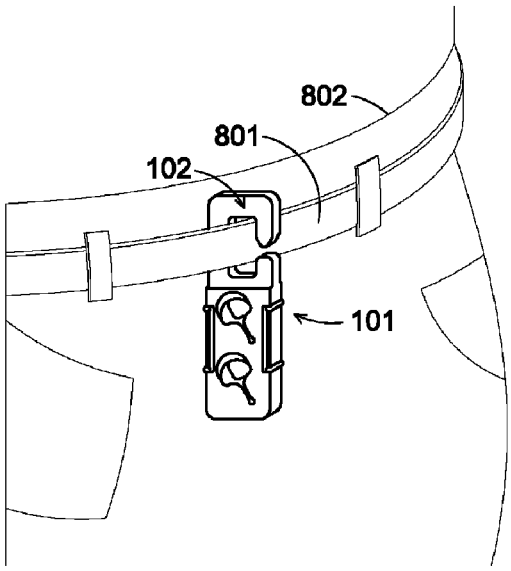
FIG. 8 shows the device from FIG. 1 attached to the waist belt of a pair of trousers.

FIG. 7 and FIG. 8 depict alternative embodiments for carrying device 101. FIG. 7 illustrates device 101 attached to a standard reel type leash 701 where the device 101 is attached by upper body 102 to the handle lower handle of leash 701. FIG. 8 illustrates device 101 attached by upper body 102 to belt 801 as wore on most trousers 802. The shallower depth of upper body 102 allows the device to comfortably slide between the belt and trousers, resulting in a firm connection and allowing the user freedom of movement while walking or running. Yet another advantage is the device is centrally located on the belt, which is effective when walking two or more animals.

Figure 4:
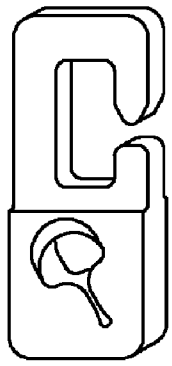
FIG. 4 shows an alternative embodiment of the device from FIG. 1.

FIG. 4 depicts an additional embodiment of the device without ribs 110L, ribs 110R and aperture 112 as previously illustrated in FIG. 3. The device is operated in the same manner as previously disclosed however, with the aforementioned members removed the weight of the device is reduced which is advantageous for activities such as running or hiking.

The waste bag carrying device can be made in a variety of sizes and proportions. Each of the apertures can be made in a variety of diameters and lengths to accommodate a variety of bag sizes. The connective hook can be made in a in a variety of lengths, widths and depths to accommodate a variety of attachment applications.

Accordingly the waste bag carrying device of the various embodiments can be used to provide hands free means to temporarily and safely transport animal waste bags. The device is made from a unitary body, does not impede the animal handlers control over the animal and accommodates a variety of bag sizes. Furthermore, the device has the additional advantages in that:

It is flexible, durable, reusable and machine washable;

It provides a reliable and low maintenance means for temporarily transporting waste bags;

It provides a means for sealing plastic bags multiple times that is not destructive.

Although the descriptions above contain many specifications, these should not be construed as limiting the scope of the embodiments but merely providing illustrations of several embodiments. Many other variations are possible. For example the hook may have other shapes; the apertures may have other shapes, the quantity of apertures may vary, etc. Accordingly the scope should be determined by the claims and not the embodiments illustrated.

The invention claimed is:

1. A waste bag carrying device comprising:

a. a unitary elongated rectangular cuboid body having a plurality of juxtaposed spaced-apart bag gathering apertures located within said body, said bag gathering apertures each comprising a concave lune shaped lead-in notch and slot extending outwardly opposite said lead-in notch and said slot further shaped so that said slot has a wide, bag gathering area which continually transition to a narrow bag gripping aperture of said slot, b. a hook and dog member means for hanging said device, and including a hook member and a dog member, said hook and dog members being formed integrally with said body, wherein said hook member may temporarily deform from said dog member allowing said device to attached to an object, c. a plurality of salient ribs juxtaposed on the surface of said body thereby creating gripping surfaces for said device, and thereby a bag guided into said bag gathering aperture by said lead-in notch and traversing said slot into said bag gripping aperture reasonably securing said bag.

2. The waste bag carrying device of claim 1 wherein the body is resilient.

3. The waste bag carrying device of claim 2 wherein the device is constructed of rubber.

4. The waste bag carrying device of claim 1 wherein the hook and dog member means is located on an opposite end from said bag gathering apertures on said body.

5. A waste bag carrying device comprising:

a. unitary elongated rectangular cuboid body having at least one juxtaposed bag gathering aperture located within said body, said bag gathering aperture comprising a concave lune shaped lead-in notch and slot extending outwardly opposite said lead-in notch and said slot further shaped so that said slot has a wide, bag gathering area which continually transition to a narrow bag gripping aperture of said slot, b. a hook and dog member means for hanging said device, and including a hook member and a dog member, said hook and dog members being formed integrally with said body, wherein said hook member may temporarily deform from said dog member allowing said device to attached to an object, and thereby a bag guided into said bag gathering aperture by said lead-in notch and traversing said slot into said bag gripping aperture reasonably securing said bag.

6. The waste bag carrying device of claim 5 wherein the body is resilient.

7. The waste bag carrying device of claim 6 wherein the device is constructed of rubber.

8. The waste bag carrying device of claim 5 wherein the body is pliant.

9. The waste bag carrying device of claim 6 wherein the device is constructed of plastic.

10. The waste bag carrying device of claim 5 wherein the hook and dog member means is located on an opposite end from said bag gathering aperture on said body.

11. A waste bag carrying device comprising:

a. unitary elongated rectangular cuboid body having two juxtaposed spaced-apart bag gathering apertures located within said body, said bag gathering apertures each including a concave lune shaped lead-in notch and slot extending outwardly opposite said lead-in notch and said slot further shaped so that said slot has a wide, bag gathering area which continually transition to a narrow bag gripping of said slot, b. a hook and dog member means for hanging said device, and including a hook member and a dog member, said hook and dog members being formed integrally with said body, wherein said hook member may temporarily deform from said dog member allowing said device to attached to an object, and thereby a bag guided into said bag gathering aperture by said lead-in notch and traversing said slot into said bag gripping aperture reasonably securing said bag.

12. The waste bag carrying device of claim 11 wherein the body is resilient.

13. The waste bag carrying device of claim 12 wherein the device is constructed of rubber.

14. The waste bag carrying device of claim 11 wherein the hook and dog member means is located on an opposite end from said apertures on said body.

* * * * *